US006789687B2

(12) United States Patent
Cramer

(10) Patent No.: US 6,789,687 B2
(45) Date of Patent: Sep. 14, 2004

(54) HOOK APPARATUS FOR HANGING ITEMS FROM A FIREPLACE MANTEL

(76) Inventor: Rebecca Cramer, 9593 Crawford Dr., Pickerington, OH (US) 43147

( * ) Notice: Subject to any disclaimer, the term of this patent is extended or adjusted under 35 U.S.C. 154(b) by 0 days.

(21) Appl. No.: 10/213,720

(22) Filed: Aug. 6, 2002

(65) Prior Publication Data

US 2003/0106868 A1 Jun. 12, 2003

(51) Int. Cl.[7] ..... A47F 5/00
(52) U.S. Cl. ..... 211/106.01; 211/104; 211/124
(58) Field of Search ..... 211/104, 118, 211/119, 106, 106.01, 124, 181.1, 57.1, 54.1, 4, 7; 248/303, 304, 687

(56) References Cited

U.S. PATENT DOCUMENTS

| | | | | | |
|---|---|---|---|---|---|
| 177,936 | A | * | 5/1876 | Haines | 211/106.01 |
| 459,011 | A | * | 9/1891 | Mahin | 211/57.1 |
| 752,203 | A | * | 2/1904 | Cook | 211/106.01 |
| 842,443 | A | * | 1/1907 | Brown | 211/106.01 |
| 974,200 | A | * | 11/1910 | Stark et al. | 452/193 |
| 1,169,056 | A | * | 1/1916 | Schweppenheiser et al. | 211/106.01 |
| 1,206,619 | A | * | 11/1916 | Treleaven | 211/57.1 |
| 1,815,673 | A | * | 7/1931 | Kelley | 211/119 |
| 2,411,856 | A | * | 12/1946 | Harding | 452/192 |
| 2,554,825 | A | * | 5/1951 | Grimberg | 211/118 |
| 2,985,315 | A | * | 5/1961 | Paruolo | 211/189 |
| 3,244,391 | A | * | 4/1966 | Brunette | 248/220.42 |
| 3,452,881 | A | * | 7/1969 | Jamison | 211/119 |
| 3,469,710 | A | * | 9/1969 | Vosbikian | 211/116 |
| 3,486,632 | A | * | 12/1969 | Balch | 248/221.11 |
| 4,027,798 | A | * | 6/1977 | Swaim | 211/4 |
| 4,129,217 | A | * | 12/1978 | Campbell | 211/95 |
| 4,243,146 | A | * | 1/1981 | Davitz | 211/118 |
| 4,300,690 | A | * | 11/1981 | Thomas | 211/4 |
| 4,367,819 | A | * | 1/1983 | Lewis | 211/59.1 |
| 4,834,248 | A | * | 5/1989 | Lee | 211/85.3 |
| 4,869,377 | A | * | 9/1989 | Mercado | 211/89.01 |
| 5,137,158 | A | * | 8/1992 | Brockway | 211/106.01 |
| 5,531,334 | A | * | 7/1996 | Forby | 211/119 |
| 5,615,783 | A | * | 4/1997 | Warnken | 211/118 |
| 5,692,581 | A | * | 12/1997 | Nelson et al. | 248/687 |
| 6,571,968 | B1 | * | 6/2003 | Cullen | 211/113 |
| 2002/0060194 | A1 | * | 5/2002 | Reiser et al. | 211/4 |

* cited by examiner

*Primary Examiner*—Jennifer E. Novosad
(74) *Attorney, Agent, or Firm*—Calfee, Halter & Griswold LLP; Courtney J. Miller, Esq.

(57) ABSTRACT

An apparatus for hanging items from a fireplace mantel or other elevated surface. The apparatus includes an elongated bar having a front edge and a rear edge, and at least one hook body detachably connected to the front edge of the elongated bar. Preferably, the elongated bar is manufactured from steel, iron, or another suitably heavy material. Each hook body includes a threaded end which may be screwed into the front edge of said elongated bar, as well as a hooked end from which various items seasonal may be hung.

4 Claims, 2 Drawing Sheets

HOOK APPARATUS FOR HANGING ITEMS FROM A FIREPLACE MANTEL

TECHNICAL FIELD OF THE INVENTION

The present invention relates generally to devices for hanging items from fireplace mantels or bookcases, and specifically to a free-standing, weighted apparatus comprising multiple detachable hooks for hanging items such as Christmas stockings or other seasonable items from a fireplace mantel.

BACKGROUND OF THE INVENTION

People living in houses, condominiums, or apartments that have fireplaces, frequently desire to hang items from the mantel above such fireplaces around the holidays or at other times of the year. Fireplace mantels are typically made of wood or some type of stone, and often the only available option for individuals wishing to hang items from the mantel is to drill holes into the wood or stone of the mantel and insert hooks into the drilled holes. Drilling holes into a mantel is problematic in that permanent damage to the mantel such as chipping, splitting, or cracking may result from the drilling. Additionally, after hooks have been inserted into the drilled holes, leaving the hooks installed when not in use may diminish the external appearance of the mantel. Likewise, removing the hooks may leave unsightly holes in the surface of the mantel.

Currently, certain weighted hooks devices are commercially available. Such devices are often in the form of a reindeer, Christmas tree, or other seasonable item and consist of a hook attached to a heavy base. These devices are free-standing, and while a stocking or other item may be hung from the hook, the device is not stable when a filled stocking is placed on the hook. Furthermore, such weighted hook devices are particularly dangerous because a child can easily grab onto the stocking and pull the weighted device off the mantel, possibly resulting in injury or even death to the child. Thus, there is a need for a free-standing, stable apparatus that provides one or more hooks for hanging items from a mantel.

SUMMARY OF THE INVENTION

These and other deficiencies of the prior art are overcome by the present invention which provides an apparatus for hanging items from a fireplace mantel or other elevated surface. This apparatus includes an elongated bar having a front edge and a rear edge, and at least one hook body detachably connected to the front edge of the elongated bar. Preferably, the elongated bar is manufactured from steel, iron, or another suitably heavy material. Each hook body includes a threaded end which may be screwed into the front edge of said elongated bar, as well as a hooked end from which various items may be hung.

Further advantages of the present invention will become apparent to those of ordinary skill in the art upon reading and understanding the following detailed description of the preferred embodiments.

DETAILED DESCRIPTION OF THE INVENTION

Reference Numerals

Figure 1:
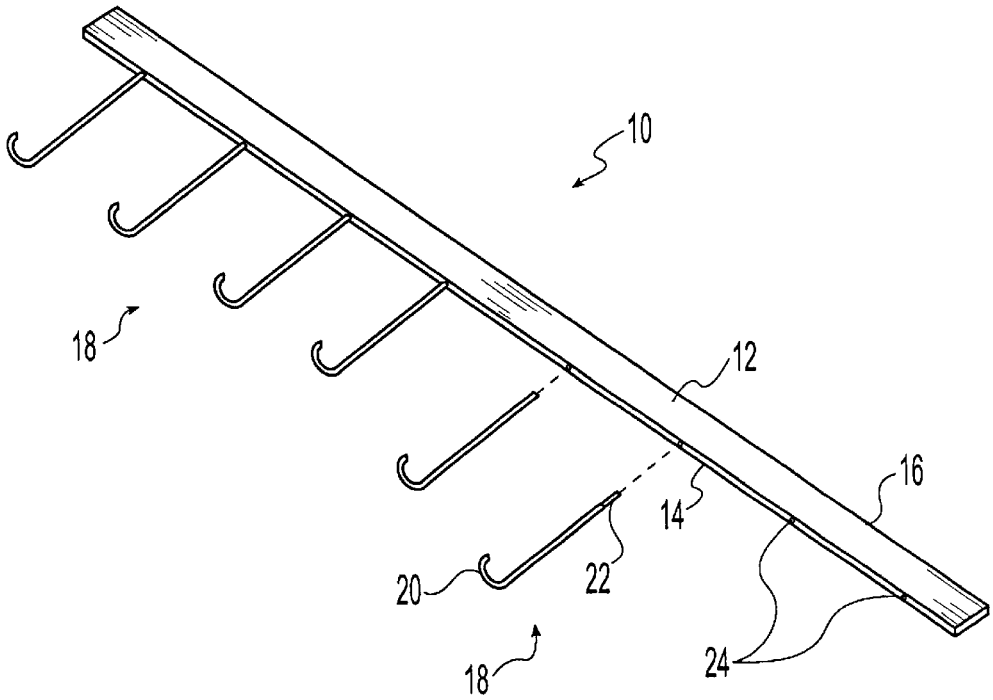
FIG. 1 is a perspective view of the hook apparatus of the present invention showing a number of the hook bodies inserted into the bar and a number of the hook bodies removed from the bar.
Figure 2:
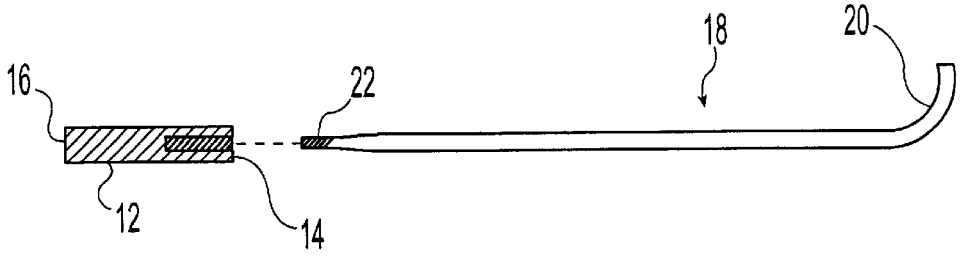
FIG. 2 is a side view of the hook apparatus of FIG. 1 showing the design and characteristics of exemplary embodiments of the bar and the hook body.
Figure 3:
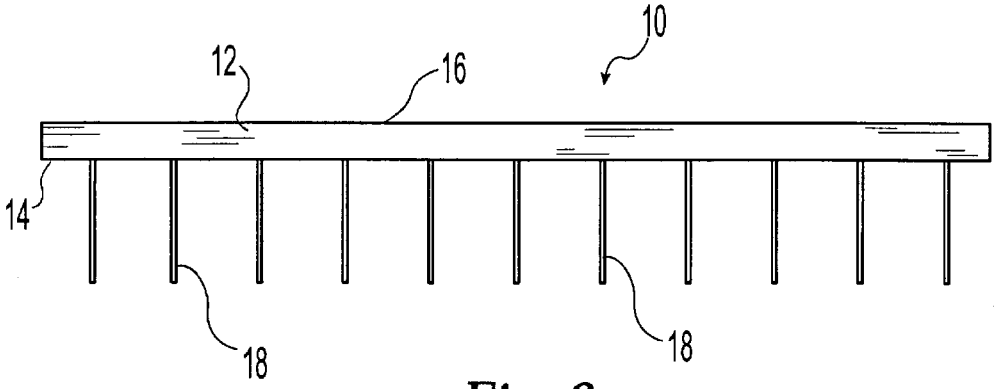
FIG. 3 is a bottom view of the hook apparatus of FIG. 1 showing the hook bodies inserted into the front edge of the bar.

10 hook apparatus
12 bar
14 front edge
16 rear edge
18 hook body
20 hooked end
22 threaded end
24 threaded aperture
26 hinge With reference to the drawings, and according to an exemplary embodiment, the present invention provides a hook apparatus for hanging items from a fireplace mantel, shelf, or other elevated surface. As shown in FIG. 1, hook apparatus 10 includes an elongated bar and at least one hook body 18. Bar 12 includes front edge 14 and rear edge 16. Bar 12 further includes a plurality of threaded apertures 24 which have been tapped into front edge 16. As also shown in FIG. 1 and in FIG. 2, hook body 18 includes hooked end 20 and threaded end 22. Threaded end 22 is compatible with threaded aperture 24, and the user of hook apparatus 10 may attach a plurality of hook bodies 18 to bar 12 by simply screwing the threaded ends 22 of the hook bodies 18 into the threaded apertures 24 on bar 12. Alternately, hook apparatus 10 can be manufactured with a plurality of hook bodies 18 already permanently attached to bar 12. FIGS. 1 and 3–5 show hook apparatus 10 with a plurality of hook bodies screwed into or otherwise attached to bar 12.

In an exemplary embodiment of this invention, bar 12 is manufactured from a single piece of iron, steel, or other metal or metal alloy and is about sixty-six inches (152 cm) in length, about 2.5 inches (6.35 cm) in width, and about 0.5 inches (1.27 cm) in thickness. At least one, and preferably a plurality of threaded apertures are formed in front edge 14 of bar 12. In an exemplary embodiment, each threaded aperture 24 is about 0.22 inches (0.56 cm) in diameter and is tapped to a depth of about 1.25 inches (3.18 cm). Preferably, hook bodies 18 are about 9.74 inches (24.8 cm) in length, about 0.25 inches (0.64 cm) in width, and hooked end 20 is about 1.25 inches (3.18 cm) in height. Preferably, threaded end 22 is about 0.19 (0.48) inches in diameter and is threaded to correspond to the threads of threaded apertures 24. In the exemplary embodiment, when hook body 18 is fully inserted into threaded aperture 24, the hook body extends about 8.5 inches (21.6 cm) outward from front edge 14.

It should be noted that the dimensions for the various components of hook apparatus 10 that are discussed herein are merely illustrative of one possible functional embodiment of this invention, and that other dimensions for the bar and hook bodies are possible, and will be determined by the characteristics of the mantel or shelf from which the putative user will hang stockings or other items. Additionally, the exemplary embodiment of the present invention is manufactured from industrial-grade steel because such steel provides sufficient weight to prevent the apparatus from slipping forward when relatively heavy items are hung from hook bodies 18. Alternate embodiments of this invention are be made from any other material that provides weight to the apparatus that is sufficient to prevent or minimize slippage or movement when the apparatus is in use.

Preferably, hook apparatus 10 is used by first screwing the hook bodies into bar 12 and then placing the apparatus on the top surface area of a fireplace mantel with the hook ends facing up. Typically, when the apparatus is properly installed for use, rear edge 16 will be substantially flush with the wall behind the mantel and the hooked end of the hook bodies will protrude over the mantel just far enough for the hook end to be useful for hanging items from the hook bodies. Installed in this manner, the exemplary embodiment of hook apparatus 10 can accommodate approximately 50 pounds (23 kg) of weight distributed across the various hook ends.

Figure 4:
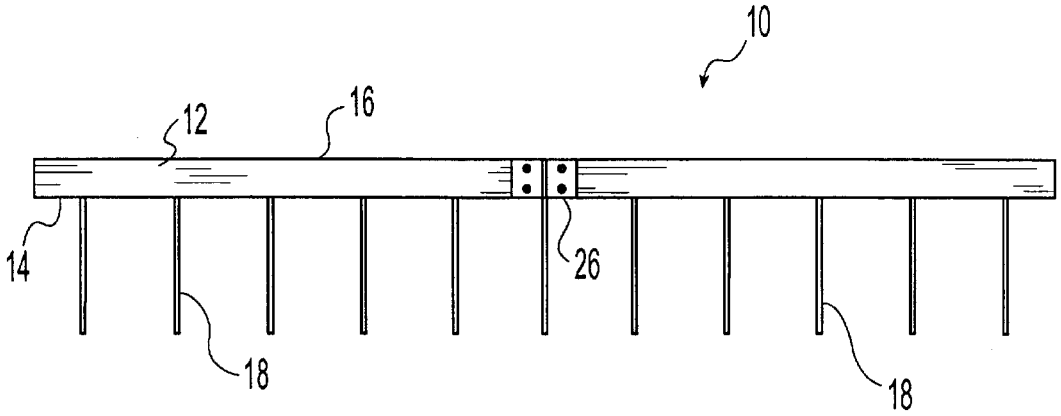
FIG. 4 is a top view of an embodiment of the present invention that includes a centrally placed hinge.
Figure 5:
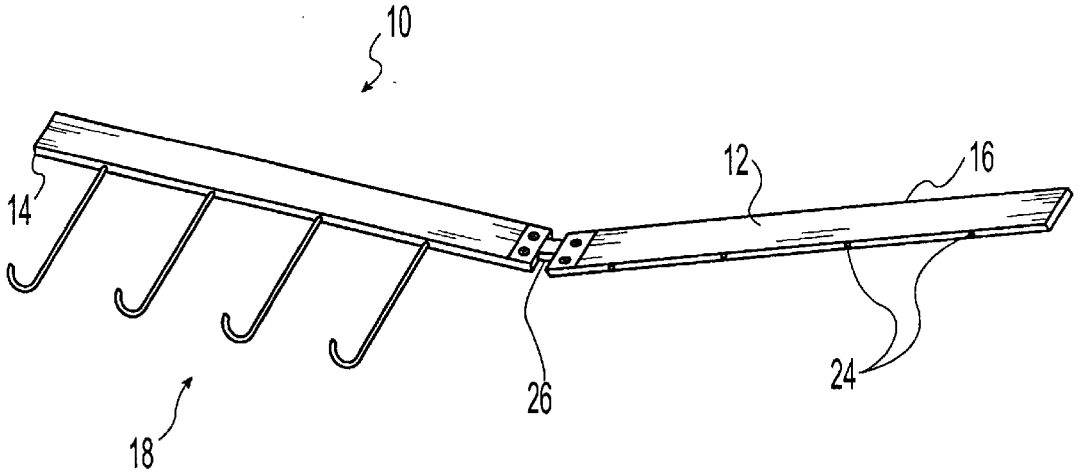
FIG. 5 is a perspective view of an embodiment of the present invention that includes a centrally placed hinge.

The exemplary embodiment of the present invention includes a bar 12 that is a single piece of metal. In other embodiments, bar 12 is manufactured in two or more smaller sections which are flexibly joined to one another with one or more hinges that allow bar 12 to be folded into smaller sections. FIGS. 4 and 5 illustrate an embodiment of this invention that includes a centrally placed hinge 26 that allows bar 12 to be folded in half. The folding embodiments of this invention offer the seller and/or user of hook apparatus 10 greater convenience in terms of handling, packaging and storing the apparatus.

In alternate embodiments, the bottom of bar 12, or the entire exterior surface of both bar 12 and hook bodies 18 are covered or coated with plastic, rubber or other protective material that reduces any tendency hook apparatus 10 may have to slide across smooth surfaces.

Hooked ends 20 may be designed to have a variety of different shapes such as leaves, pinecones, or candy-canes. Although not shown in the drawings, bar 12 may include clips or fasteners on one or both ends of the bar that attach to a mantel or other surface to lend greater stability to hook apparatus 10. Bar 12 may also include one or more apertures at both ends of the bar from which weights may be hung to add greater stability to hook apparatus 10.

While the above description contains many specificities, these should not be construed as limitations on the scope of the invention, but rather as exemplification of preferred embodiments. Numerous other variations of the present invention are possible, and it is not intended herein to mention all of the possible equivalent forms or ramifications of this invention.

What is claimed:

1. An apparatus for hanging items, comprising:

(a) an elongated bar, said bar further comprising substantially flat top and bottom surfaces and substantially flat front and rear surfaces, and wherein said bar is manufactured from steel, iron or metal alloy;

(b) a plurality of apertures formed in and spaced at regular intervals along said front surface of said bar, and wherein said apertures further comprise a threaded inner surface;

(c) at least one hook body attachable to said front surface of said elongated bar, and wherein said hook body further comprises a hooked end for hanging items from said hook body and a substantially straight end, and wherein said straight end further comprises a threaded outer surface corresponding to said threaded inner surface of said apertures; and (d) a means for reducing any tendency of said apparatus to slide across a surface, said means further comprising a non-sliding material attached to at least one of said bottom surface of said bar or said at least one hook body;

wherein a thickness of the elongated bar is defined between the top and bottom surfaces, and a width of the elongated bar is defined between the front and rear surfaces whereby the thickness is less than the width; wherein when said apparatus is placed on a substantially horizontally oriented support surface, such that the bottom surface of the elongated bar lies on the support surface, the front surface of the elongated bar is oriented substantially perpendicularly to the support surface and a portion of the hook body between the straight end and the hooked end is substantially parallel to the top and bottom surfaces of the elongated bar so that items suspended from the hooked end will be suspended substantially perpendicularly to the top and bottom surfaces of the elongated bar and substantially therebelow.

2. The apparatus of claim 1, wherein said elongated bar is about sixty-six inches (152 cm) in length, about 2.5 inches (6.35 cm) in width, and about 0.5 inches (1.27 cm) in thickness.

3. The apparatus of claim 1, wherein said elongated bar is manufactured in at least two sections, and wherein said sections are flexibly joined together by at least one hinge.

4. The apparatus of claim wherein 1, wherein said hook body is about 9.74 inches (24.8 cm) in length and 0.25 inches (0.64 cm) in width, and wherein said hooked end is about 1.25 inches (3.18 cm) in height and said threaded end is about 0.19 (0.48) in diameter.

* * * * *